US005363559A

United States Patent [19]

McCarty

[11] Patent Number: 5,363,559

[45] Date of Patent: Nov. 15, 1994

[54] TELESCOPE INNER TUBE LOCKING DEVICE AND METHOD

[75] Inventor: John P. McCarty, Greeley, Colo.

[73] Assignee: Burris Company, Greeley, Colo.

[21] Appl. No.: 977,114

[22] Filed: Nov. 16, 1992

[51] Int. Cl.[5] ..... F41G 1/38

[52] U.S. Cl. ..... 33/246; 33/248; 33/298; 359/428

[58] Field of Search ..... 33/245, 246, 247, 248, 33/297, 298; 359/417, 418, 427, 428, 811, 815, 819, 822

[56] References Cited

U.S. PATENT DOCUMENTS

| | | | |
|---|---|---|---|
| 843,183 | 2/1907 | Smith | 33/248 |
| 1,609,789 | 12/1926 | Belding | 33/248 |
| 2,018,549 | 10/1935 | Ekdahl | 33/248 |
| 2,165,796 | 7/1939 | Humeston | 33/248 |
| 2,548,861 | 4/1951 | Brown | 33/46 |
| 3,008,237 | 11/1961 | Harris | 33/50 |
| 3,121,163 | 2/1964 | Rickert | 250/77 |
| 3,161,716 | 12/1964 | Burris et al. | 88/32 |
| 3,222,987 | 12/1965 | Wrigglesworth | 88/32 |
| 3,476,349 | 11/1969 | Smith | 33/248 X |
| 3,642,341 | 3/1972 | Seifried . | |
| 4,397,107 | 8/1983 | Holden | 33/248 X |
| 4,436,421 | 3/1984 | Suzuki | 356/153 |
| 4,584,776 | 4/1986 | Shepherd | 33/246 |
| 4,721,375 | 1/1988 | van Dulmen . | |
| 4,943,149 | 7/1990 | Wahlen et al. . | |
| 4,982,502 | 1/1991 | Weyrauch | 33/248 |
| 4,986,645 | 1/1991 | Ekstrand | 350/560 |

*Primary Examiner*—Alvin Wirthlin
*Attorney, Agent, or Firm*—Norvell E. Von Behren, Michael A. Capraro

[57] ABSTRACT

A telescope inner tube locking device and method for positively locking the telescope inner tube in it's previously aligned position. The locking is accomplished by using a biased locking screw which operates to apply a force against the inner tube of the telescope while the windage and elevation adjustment screws on the telescope are moved. Thereafter, the biased locking screw locks the inner tube against the windage and elevation adjustment screws. In a modification of the preferred embodiment, the inner tube of the telescope may also be locked by using a locking screw constructed similarly to the elevation or windage screws in combination with a separate spring bias. The separate spring bias will apply a force against the windage and elevation screws of the telescope and the locking screw will lock the inner tube in place. The tube may also be locked by a third locking screw without using a bias. The methods disclosed herein use the applicant's invention to positively lock the inner tube in it's desired aligned position so that an accidental dropping or jarring of the firearm or heavy recoils of the firearm will not result in a misalignment of the previously aligned inner tube of the telescope.

8 Claims, 4 Drawing Sheets

TELESCOPE INNER TUBE LOCKING DEVICE AND METHOD

BACKGROUND OF THE INVENTION

This invention relates generally to telescopes and in particular to a new and novel telescope inner tube locking device and method for adjusting and then positively locking the inner tube usually known as the erector guide tube.

In a telescope of the type before mentioned, an outer tube of the telescope contains the inner erector guide tube which in turn holds the optics of the telescope and the reticle which provides a means for defining an aiming point which will be coincident with the point of impact of the bullet on the target. The reticle may take the form of a cross hair, dot and post types as well as other types.

Prior to using a rifle, handgun or shotgun in all areas for target or game shooting with a telescope attached to the firearm, adjustments are made to the position of the telescope inner erector guide tube to introduce corrections in the line of sight to compensate for windage, the distance to the target, the ballistic characteristics of a particular cartridge and to zero-in the telescope to the axis of the firearm barrel to which the telescope is attached.

These adjustments are also required due to the dimensional variations in the telescope mounts and the mechanical axis of the telescope which is rarely exactly in line with the barrel of the firearm. In addition, the trajectory of a bullet does not coincide with the line of sight which is always straight and requires test firings followed by adjustments of the inner erector guide tube that holds the optics and the reticle.

These adjustments are made in prior art devices by turning a pair of windage and elevation control screws which are spring biased with the bias spring being positioned opposite to the adjustment screws. For a more detailed discussion of the construction of the inner erector guide tube and it's placement in the outer telescope tube as well as to the adjustment screw construction, reference should generally be made to the patents cited herein and specifically to the applicant's U.S. Pat. No. 3,161,716 of D. J. Burris et al and the U.S. Pat. No. 3,222,987 of N. A. Wrigglesworth which show details on typical adjustment screw designs.

In the prior art of telescope design it is known to use various mounting configurations for holding the optics as shown in the U.S. Pat. No. 4,436,421, issued on Mar. 13, 1984 to K. Suzuki and in the U.S. Pat. No. 4,943,149, issued on Jul. 24, 1990 to E. Wahlen et al.

It is also known to provide telescopes with one adjustment screw which is spring biased by a single bias spring as shown in the U.S. Pat. No. 3,121,163, issued on Feb. 11, 1964 to G. E. Rickert and in the U.S. Pat. No. 4,986,645, issued on Jan. 22, 1991 to J. A. I. Ekstrand.

It is also known to use two adjustment screws with one bias spring which is usually a leaf spring. These configurations are shown in the U.S. Pat. No. 2,546,861, issued on Apr. 17, 1951 to L. H. Brown; in the U.S. Pat. No. 3,008,237, issued on Nov. 14, 1961 to H. N. Harris; in the U.S. Pat. No. 3,161,716, issued on Dec. 15, 1964 to D. J. Burris et al; in the U.S. Pat. No. 3,222,987, issued on Dec. 14, 1965 to N. A. Wrigglesworth; and in the U.S. Pat. No. 4,982,502, issued on Jan. 8, 1991 to A. Weyrauch.

It is also known to use two adjustment screws with two spring bias members as shown in the U.S. Pat. No. 3,642,341, issued on Feb. 15, 1972 to P. Selfried; in the U.S. Pat. No. 4,721,375, issued on Jan. 26, 1988 to H. A. M. van Dulmen; and in the U.S. Pat. No. 4,584,776, issued on Apr. 29, 1986 to D. R. Shepherd.

While the above mentioned constructions may be suitable for the purposes designed, they do not recognize the problems inherent in the use of only a bias spring acting against the adjustment screws. It has been found from experimentation over the years that once the two adjustment screws are set to a desired position by test firings of the firearm, the spring bias may not be sufficient to positively hold or lock the selected settings in place causing a misalignment and requiring more alignment test firings.

The misalignment can occur from repeated discharge of the firearm with heavy recoils that can cause misalignment of the previously set scope inner tube position. In addition, an accidental jarring or a dropping of the firearm can cause misalignment and may change the adjustment screw settings. In other words, the use of only a spring bias against the adjustment screw is sufficient during the adjustment of the screws but may not be sufficient to hold the erector guide tube in a locked position once the proper setting of the adjustment screws is obtained.

Misalignment can also occur from a backlash in the threads of the adjustment screws which is not always overcome by the bias spring acting on the adjustment screws. The applicant's novel device herein described will force this backlash out so that the misalignment can not occur.

SUMMARY OF THE INVENTION

In order to overcome the before mentioned deficiencies in prior art designs, there is provided by the subject invention a new and novel structure to positively lock the inner guide tube in the desired position in the telescope. This is accomplished by providing the telescope with at least one locking means that may be positioned opposite to the two prior art windage and elevation adjustment screws in the preferred embodiment. The locking means may be used with a self contained bias or force spring or with a separate bias or force spring positioned within the telescope mount. The locking means may also be used without using a bias.

The prior art telescope windage and elevation adjustment screws are operated in the usual manner in the applicant's device with a spring force or bias being used, as in prior art devices, to apply a force against the adjustment screws. Thereafter, the applicant's novel locking device may be moved to a position against the outer surface of the inner erector guide tube to tightly lock the inner erector tube against the windage and elevation adjustment screws in at least a three-point fixed and locked position. As a result, heavy recoils from discharge of the fire arm or an accidental jarring or a dropping of the firearm will not cause misalignment of the telescope setting as can happen when using only a spring bias force without a positive lock screw to bias the inner tube as in the prior art. In addition, backlash in the elevation and windage adjustment screws is eliminated.

Accordingly, it is an object and advantage of the invention to provide a positively locked inner tube for a telescope using either a biased locking screw positioned opposite to the existing windage and elevation adjustment screws or to provide a separate bias means with a separate locking screw or to provide a separate locking screw without using a bias.

Another object and advantage of the applicant's invention is to provide a novel biased locking device that may replace the existing bias force spring or springs used in prior art designs.

A further object and advantage of the invention is to provide a novel device and a novel method of adjusting and positively locking a telescope inner erector guide tube using the novel device in a desired position so that the erector guide tube is not capable of moving from it's aligned position regardless of heavy firing recoils or an accidental dropping or a jarring of the firearm.

These and other objects and advantages of the invention will become apparent from reading the following specification and from reviewing the drawings herein provided which show and describe the invention in it's various aspects.

DESCRIPTION OF THE PREFERRED EMBODIMENT

Figure 1:
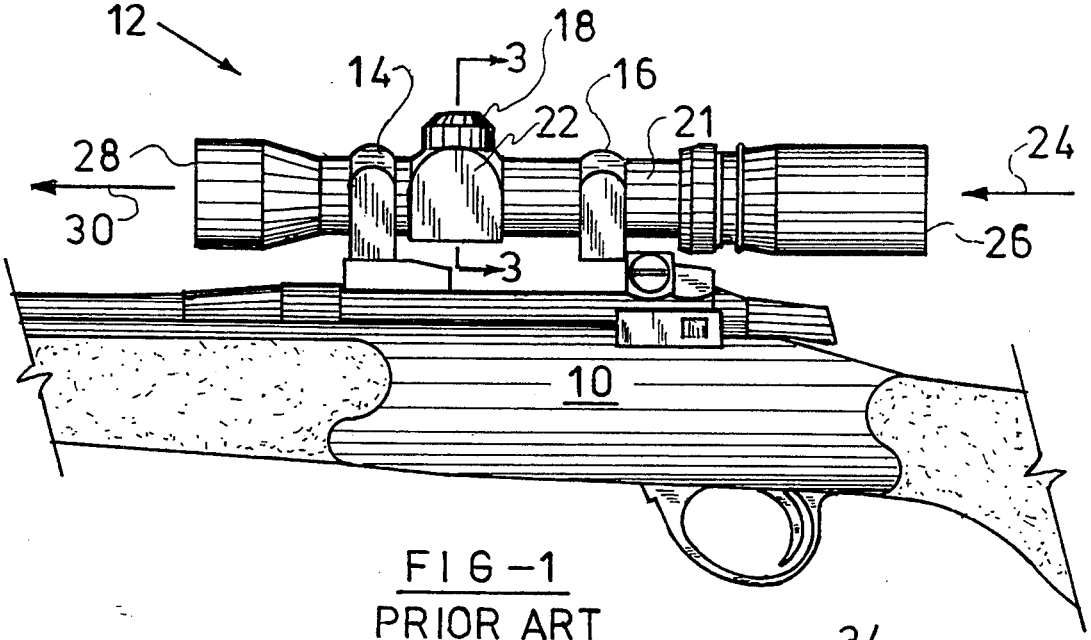
FIG-1 PRIOR ART
FIG. 1 is a side view of a prior art rifle showing a typical telescope attached to the rifle.

Referring now to the drawings in general and in particular to FIG. 1 of the drawings, there is shown a side view of a prior art rifle 10 which has a typical telescope 12 attached to the top of the rifle by the telescope mountings 14 and 16.

The telescope 12 has an optical lens grouping inside as well as a reticle which is the sighting device for viewing the target. The telescope also may have various mechanical devices inside to move the optical lenses as well as the reticle during the sighting procedures.

One of the mechanical devices is called an erector guide tube which is moved by two adjustment screws 18 and 20. The adjustment screw 20 is not shown in FIG. 1 but can be seen in the other drawing views. The adjustment screws 18 and 20 of the telescope 12 are attached to the outer tube mounting area 22 which is an enlarged section of the outer tube 21 of the telescope.

The horizontal and vertical placement of the recticle which is located inside the inner erector guide tube may be adjusted by moving one end of the erector guide tube while the other end remains attached to inner surface of the telescope outer tube 21 by various prior art attachments.

This is first accomplished by sighting a target through the end 26 of the telescope in the direction of the arrow 24 and out the end 28 in the direction of the arrow 30. A test firing of the rifle 10 is then made while observing the location of the projectile hit on a target.

The pair of adjustment screws 18 and 20 are then used to make any necessary adjustments for horizontal and vertical correction. The adjustment for the horizontal angle or position of the inner tube is called the windage adjustment 20 while the adjustment for a vertical position of the inner tube is called the elevation adjustment 18.

Figure 2:
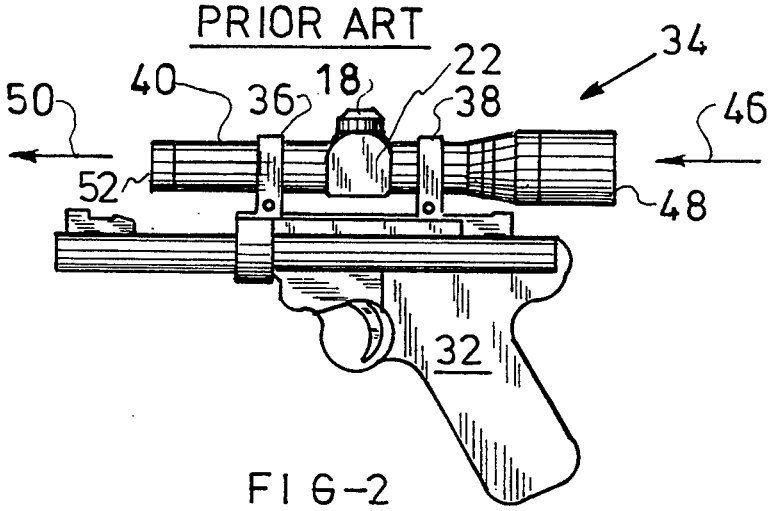
FIG-2 PRIOR ART
FIG. 2 is a side view of a prior art pistol showing a typical telescope attached to the pistol.

Referring now to FIG. 2 of the drawings, there is shown a side view of a prior art handgun 32 to which a handgun telescope, shown generally by the numeral 34, may be mounted by the mounting areas 36 and 38. The windage adjustment screw 20 and the elevation adjustment screw 18 are positioned as in the long gun or rifle telescope on the outer tube 40 and specifically on the outer tube mounting area 22 which is similar in construction to the long gun or rifle outer tube mounting area 22.

While the windage adjustment screw 20 is not shown in FIG. 2, it's placement is the same as in the rifle telescope 12. The pistol telescope is also adjusted in a similar manner to the above rifle telescope by sighting through the end 48 of the telescope 34 in the direction of the arrow 46 to the other end 52 in the direction 50 at the target. Thereafter the proper adjustment of the handgun telescope 34 is the same as before mentioned for the long gun or rifle telescope.

Figure 3:
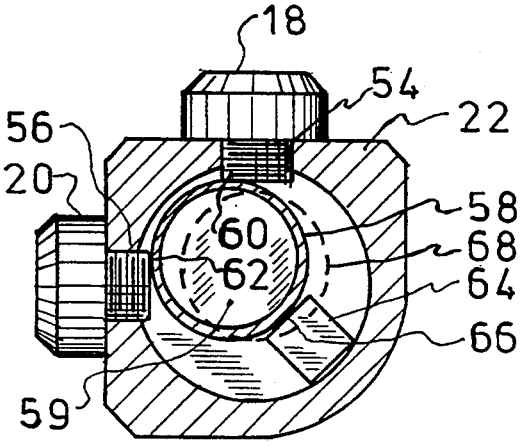
FIG-3 PRIOR ART
FIG. 3 is a cross sectional view, taken through lines 3—3 of FIG. 1 showing the inside of the telescope of FIG. 1 or FIG. 2 and how a typical prior art telescope uses two adjustment screws with an oppositely positioned spring bias only on the inner erector guide tube.

Referring now to FIG. 3 of the drawings, there is shown a cross sectional view, taken along lines 3—3 of FIG. 1 and showing a typical prior art elevation and windage adjustment construction to move the inner erector guide tube 58 inside the outer tube 21 and the outer tube mounting area 22 during the alignment procedure. The FIG. 3 view would also be typical for the pistol telescope outer tube 40 and the outer tube mounting area 22 of FIG. 2 of the drawings.

It can be seen in FIG. 3 how the adjustment screws 18 and 20 have threaded sections 54 and 56 which can be turned by the adjustment screws 18 and 20 to move the inner erector guide tube 58 to a desired position such as the position shown dashed as numeral 68 in FIG. 3. This then moves the internal lens system 59 to which the reticle is attached.

By turning the adjustment screws 18 and 20, the ends 60 and 62 of the adjustment screws engage the erector tube 58 and can move the tube as desired against the action of a spring force or bias 64 which also presses or grounds on the erector tube 58 at 66 as shown. In prior art devices such as shown in FIG. 3, the spring force or bias 64 may be a leaf spring or a coil spring or some other configuration. The spring force or bias 64 may also be in the form of a pair of leaf springs 70 and 72 as shown in the prior art view of FIG. 4.

Figure 4:
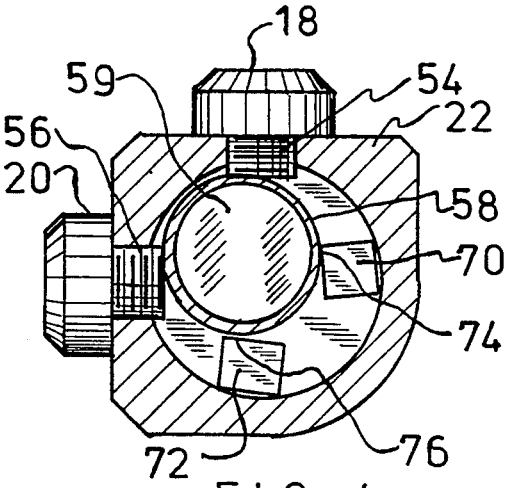
FIG-4 PRIOR ART
FIG. 4 is a cross sectional view, similar to the view of FIG. 3 showing another typical prior art device using two oppositely positioned bias springs only to provide bias to the two adjustment screws.

This dual spring force bias gives added force to the inner erector guide tube 58 by providing the force at the two points 74 and 76 shown in FIG. 4. The additional spring force can operate to aid in holding the properly adjusted inner erector guide tube in it's desired position under normal conditions.

However, the use of a single or dual spring force does not provide sufficient holding ability when the firearm may be jarred or accidently dropped. Also the use of a single or dual spring force does not prevent movement of the inner erector guide tube from repeated heavy recoils of the firearm using high powered ammunition or in the case of air guns, the action of the spring that operates the air gun plunger or pistons.

Figure 5:
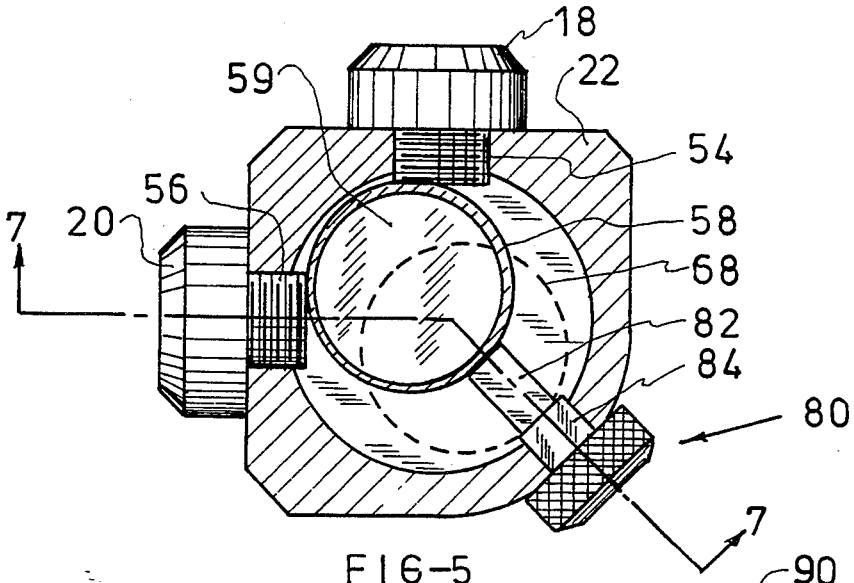
FIG. 5 is a cross sectional view, similar to the view of FIG. 3 showing the applicant's new and novel biasing locking means which combines a locking screw with a spring bias and which will be described more fully hereinafter.

Turning now to FIG. 5 of the drawings, there is shown a cross sectional view, similar to the view of FIG. 3 showing the applicant's new and novel biased locking means. The novel biased locking means, shown generally by the numeral 80, is positioned in the outer tube mounting area 22 opposite to the two prior art windage and elevation adjustment screws 18 and 20 in the position shown. It may also be positioned in other places within the outer tube 21 or 40 as will be described in detail hereinafter. In addition, the windage adjustment screw 20 can also be placed on the other side of the outer tube. The elevation adjustment screw 18 could be placed at the top or bottom of the outer tube.

In the preferred embodiment shown, the novel biased locking means comprises a tube biasing means 82 used in combination with a tube biasing locking means 84. By biasing, it is meant that, for example, a spring urges a constant or variable force on an adjacent surface that is engaging the spring and the spring returns to it's previous non-engaged position when the adjacent surface is removed.

FIG. 5 shows the applicant's novel invention generically and the actual construction of the preferred embodiment of the novel biased locking means will be described later when referring to FIGS. 9 and 10 of the drawings. Other types of biasing locking means are considered to be within the spirit and scope of the invention and the applicant is not to be limited to the types shown which are given by way of illustration only.

When the applicant's positive biased locking means 80 is used as shown, it will replace the standard spring bias types generally used in prior art devices. The tube biasing means 82 will urge or force the inner tube 58 against the windage and elevation adjustment screws 18 and 20 during the alignment of the telescope as in the prior art. Thereafter the tube biasing locking means 84 may be operated to inactivate the spring bias and to positively lock or rigidly hold the inner erector guide tube 58 against the two adjustment screws 18 and 20.

This arrangement positively locks the inner tube 58 in a rigid three or more point locked position. Other variations will be shown later in the drawings and will be described in the specification and also are considered to within the spirit and scope of the applicant's invention.

Figure 6:
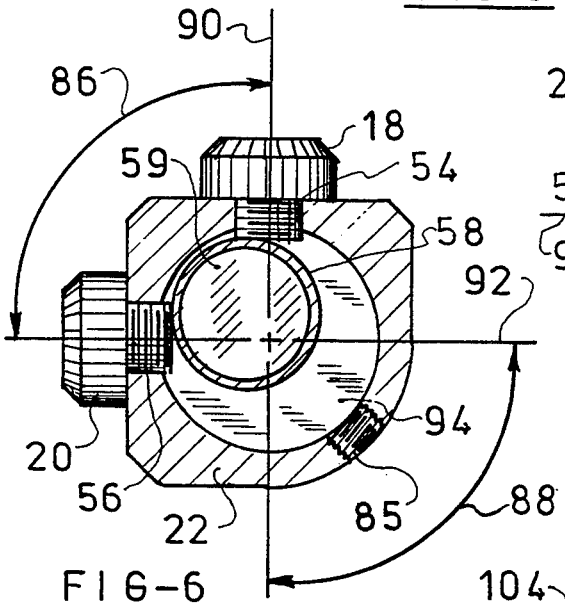
FIG. 6 is a cross sectional view, similar to the view of FIG. 5 with the applicant's novel biasing locking means being removed for purposes of clarity and to show the oppositely positioned zones of adjustment and biasing when using the applicant's device.

Turning now to FIG. 6 of the drawings, there is shown a cross sectional view, similar to the view of FIG. 5 and showing the applicant's novel bias locking means 80 removed to clearly describe where the device may be positioned on an internal thread 85 which has been formed in the outer tube mounting area 22 as shown. The biasing locking means 80 is unscrewed from this thread 85 in FIG. 6.

The standard elevation and windage adjustment screws 18 and 20 usually are positioned in a zone on the telescope which we have called the adjustment zone shown by the numeral 86 between the center lines 90 and 92. This zone usually spans an area of about 90 degrees in most telescopes.

It is believed that the best position for the applicant's novel biased locking means 80 would be preferably in a bias or force zone 88 around the same centerlines 90 and 92 but opposite to the two adjustment screws 18 and 20. This zone is shown by the numeral 88 in FIG. 6 of the drawings.

It is also believed that both the adjustment zone 86 as well as the bias or force zone 88 can also be in other positions in the telescope. In other words, the novel bias locking means of the applicant's invention and it's modifications can also be positioned along the length of the erector guide tube 58 as well as being in the same plane as the two adjustment screws 18 and 20. In addition, the adjustment screws 18 and 20 can also be relocated along the longitudinal axis of the erector tube.

Figure 7:
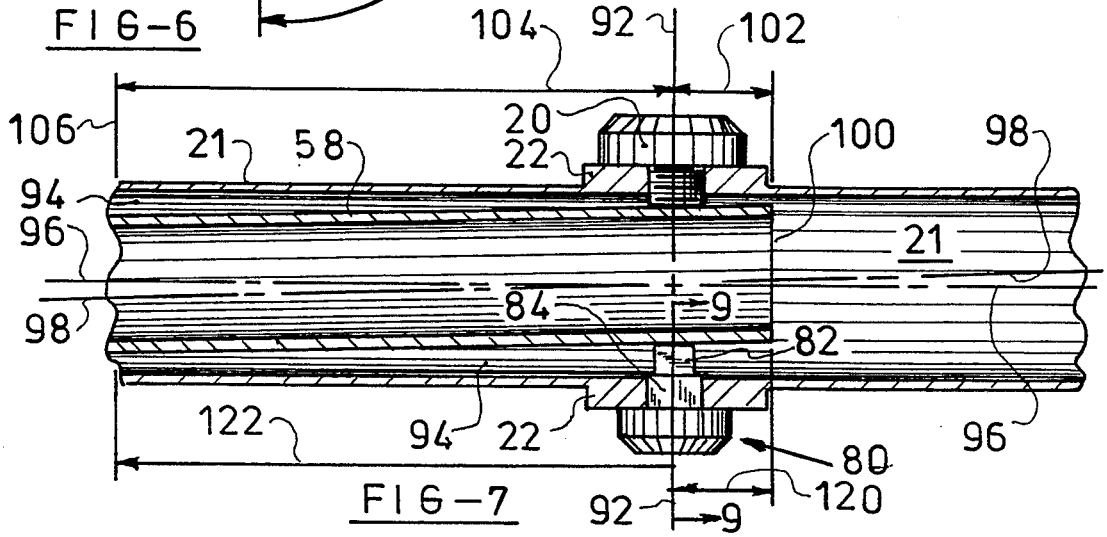
FIG. 7 is a cross sectional view, taken along lines 7—7 of FIG. 5, showing the relative positions of the various zones in the applicant's novel device.

In FIG. 7 of the drawings there is shown a cross sectional view, taken along lines 7—7 of FIG. 5. In the usual telescope construction, the two adjustment screws 18 and 20 are positioned as shown and the spring bias force is positioned generally in the same vertical plane. The two adjustment screws 18 and 20 can also be positioned along the longitudinal axis 96 of the outer tube 21 in the areas along the distance shown by the numerals 102 and 104.

In addition, the bias locking means 80 of the applicant's invention can also be placed along the longitudinal axis 98 of the inner erector guide tube 58 in the areas along the distance shown by the numerals 120 and 122. It is believed that the various parts used in the adjusting of the inner erector guide tube of the telescope could then be positioned anywhere between the end 100 of the erector guide tube 58 and the other end 106 of the tube 58. This would be along the numerals 102 and 104 as well as the numerals 120 and 122 as shown in FIG. 7.

The longitudinal axis 98 of the inner erector guide tube is moveable off of the longitudinal axis 96 of the outer tube 21 during the adjustment of the telescope as it is moveable inside the area 94 as shown in FIG. 7. It is in this zone that both of the adjustment screws 18 and 20 as well as the spring bias force and the bias lock may be located within the spirit and scope of the applicant's invention.

As a result, the zone of adjustment of the telescope windage and elevation screws 18 and 20 as well as the zone of biasing where the biasing force is applied to the inner tube 58 may thereby extend along the longitudinal axis of the outer and inner tubes in addition to being in the vertical plane shown in FIG. 6 by the numerals 86 and 88.

The length of the outer tubes 21 and 34 of the usual rifle and pistol telescopes may range from approximately 4 inches to 20 inches in length. As a result, the range of inner tube lengths, shown between the numerals 100 and 106 may range from approximately 3 inches to 12 inches in length. It is believed that the adjustment zone and the bias zone may be within these parameters.

Figure 8:
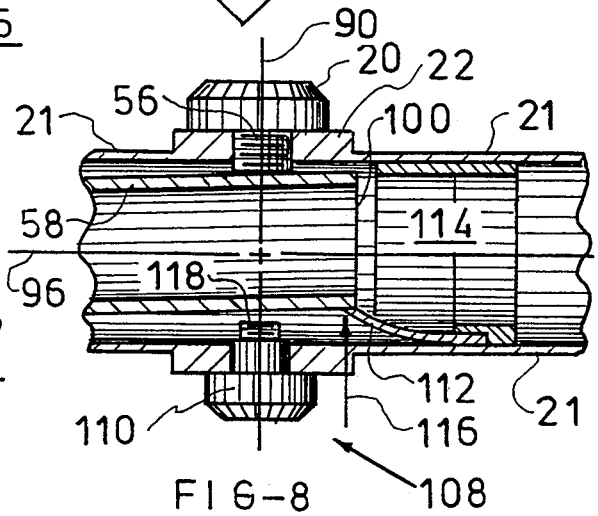
FIG. 8 is a partial cross sectional view, similar to the view of FIG. 7 showing a modification of the applicant's novel device and showing one end of the inner erector guide tube with a separate spring bias along with a separate locking screw for biasing and for locking the guide tube in it's previously selected position.

While the applicant's biasing locking means 80 may be used as described, the applicant has also discovered that the inner erector guide tube 58 may be biased by a separate bias spring after which the guide tube 58 may be locked by a separate third locking means. This is shown in FIG. 8 of the drawings which is a partial cross sectional view, similar to the view of FIG. 7 and which shows a modified device generally by the numeral 108.

A locking or adjustment screw 110, similar to the standard type elevation and windage adjustment screws 18 and 20, may be positioned as shown in the bias or force zone 88. It may then operate in combination with a separate spring bias 112 which is positioned to force or bias the end 100 of the inner erector guide tube 58 as shown in FIG. 8.

A spring holder 114 for the spring bias 112 may be used to retain the leaf spring bias 112 in the proper position to bias or apply a force to the end of the inner erector guide tube 58 in the direction shown by the arrow 116. After the desired adjustment of the telescope is obtained, the locking screw 110 may then be turned to move the end 118 of the screw against the inner erector tube 58 and to force the inner erector guide tube 58 against the two adjustment screws 18 and 20 to lock the tube in a three-point locked position.

As before mentioned, other positions of the locking screw 110 and positions of the separate spring force bias 112 may be used in the bias zone in this embodiment within the spirit and scope of the applicant's invention.

Referring now to the drawing FIGS. 9, 10 and 11 there will be described in some detail the applicant's new and novel biasing locking means 80 before mentioned as the preferred embodiment. In FIGS. 9 and 11 there is shown a spring cap 124 and a bias spring 126 which are designed to provide a force or bias to the outer side 128 of the inner tube 58. A locking screw 130 has an upper inner bore 131 designed to receive the spring cap 124 and to permit it to move inside the upper inner bore 131.

The locking screw 130 also has a lower inner bore 132 designed to receive the lower portion of the bias spring 126 with the upper portion of the bias spring 126 being positioned inside the spring cap 124. This arrangement permits the spring cap 124 to move with the outer surface 128 of the inner tube 58 in the direction shown by the arrow 133 in FIG. 9 as the inner tube 58 is being aligned and moved by the windage and elevation adjustment screws 18 and 20. The spring 126 and the spring cap 124 thereby apply a force or bias to the inner tube to keep it tightly positioned against the adjustment screws 18 and 20.

Figure 9:
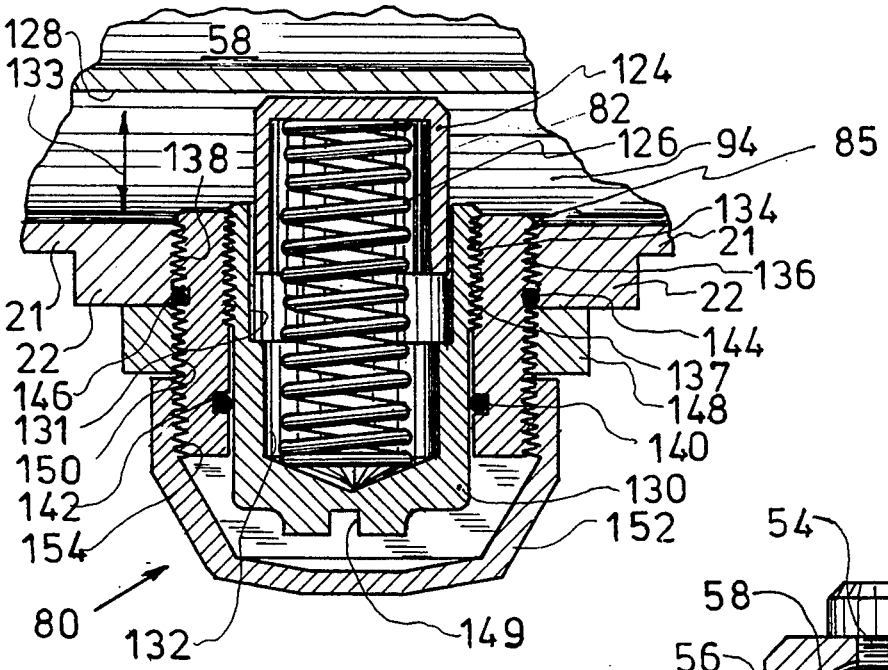
FIG. 9 is a cross sectional view of the applicant's novel spring biasing locking means of the preferred embodiment.

The locking screw 130 has an outer threaded portion 134 formed on it's upper end as can be seen in FIGS. 9 and 11. This outer threaded portion 134 mates with an inner threaded portion 137 formed on the inside of a lock bushing 136. The lock bushing 136 also contains an inner lower O-ring 140 positioned on the inside thereof in a lower O-ring slot 142 as well as an upper O-ring 144 positioned on the outside thereof in an upper O-ring slot 146 to prevent the entry of contaminants and moisture to the inside area 94 between the outer tube 21 and the inner erector guide tube 58. The O-rings also prevent loss of the dry nitrogen that is used to purge contaminants from the telescope.

The lock bushing 136 also contains an outer threaded portion 138 formed on the entire outer length of the bushing. This thread mates with a similar thread 85 formed in the outer tube mounting area 22 of the telescope shown in FIG. 6 as well as with a mating thread 150 formed in the inside of a lock ring 148.

Figure 10:
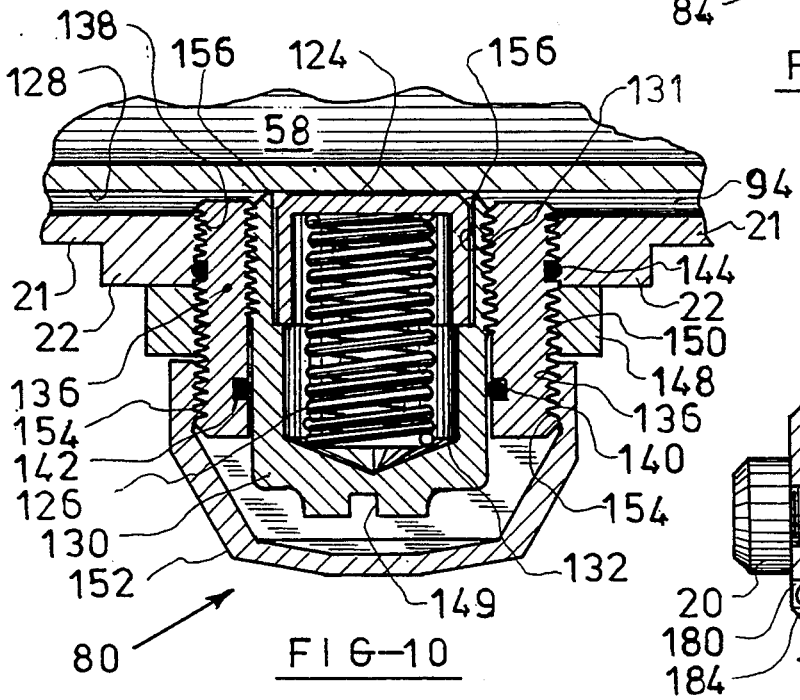
FIG. 10 is a cross sectional view, similar to the view of FIG. 9 showing the novel device in a locked position with the spring bias inactivated within the device.
Figure 11:
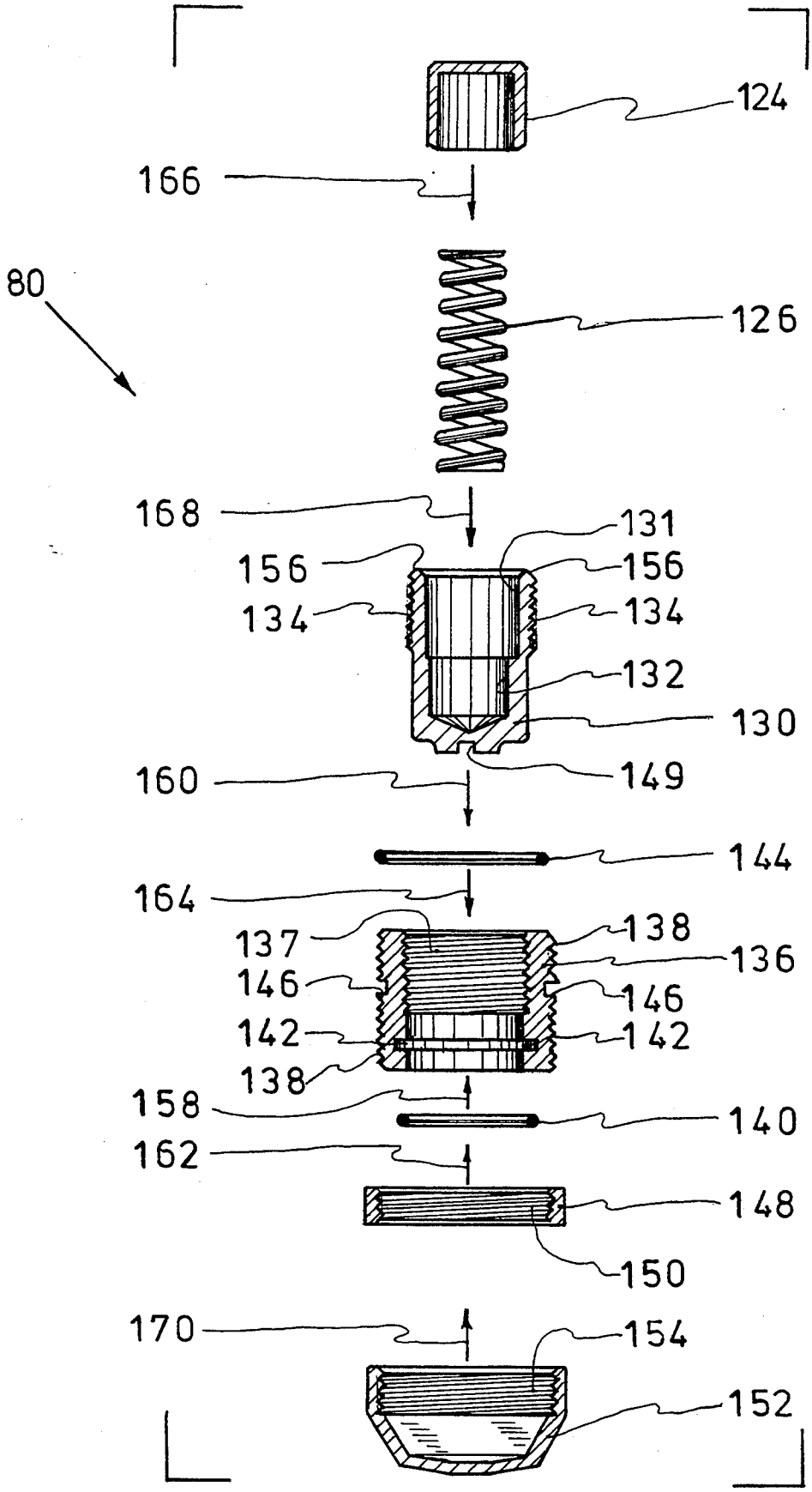
FIG. 11 is an exploded view of the applicant's novel spring biasing locking device showing the various parts of the novel device prior to assembly.

A dust cap 152 contains an internal thread 154 which also mates with the outer thread 138 formed on the outside of the lock bushing 136 and permits the dust cap 152 to be screwed onto the lock bushing 136 as shown in FIGS. 9 and 10 as will be described more fully hereinafter.

The locking screw 130 also contains a lower slot 149 which is designed to receive a lock tool (not shown), such as a small screw driver. This lock tool is then used to turn the locking screw 130 inside of the lock bushing 136 to lock the movement of the inner tube 58 after the proper adjustment is completed which is illustrated in FIG. 10 of the drawings and will be described hereinafter.

Referring now briefly to FIG. 11 of the drawings, there is shown an exploded view of the applicant's novel biased locking means 80 and there will be now described one of the several ways to assemble the novel biased locking means 80. This will help the reader to more fully understand the inner construction of the device in the preferred embodiment.

In the assembly of the applicant's novel bias lock means 80 to the telescope, the inner O-ring 140 is positioned upwardly in the direction shown by the arrow 158 and is inserted into the inner O-ring slot 142 on the lock bushing 136. Then the locking screw 130 is positioned downwardly in the direction shown by the arrow 160 and is screwed into the inside of the lock bushing 136 with it's lower portion engaging the inner O-ring 140 as shown in FIG. 9 of the drawings. The lock ring 148 is then positioned upwardly in the direction shown by the arrow 162 and is screwed onto the outside of the lock bushing 136.

Thereafter the upper outer O-ring 144 may be moved downwardly as shown by the arrow 164 and may be positioned inside the outer upper O-ring slot 146. The bias spring cap 124 is positioned downwardly as shown by the arrow 166 onto the bias spring 126 as shown in FIG. 9 of the drawings. The force bias spring 126 and the spring cap 124 are then positioned in the locking screw 130 by positioning the bias spring downwardly in the direction shown by the arrow 168. The lower end of the bias spring 126 then fits inside the lower inner bore 132 with the spring cap 124 being positioned in the upper inner bore 131 of the locking screw 130 as shown.

The lock bushing 136, containing the lock screw 130, the bias spring 126 and the spring cap 124 as well as the two O-rings 140 and 144 is then screwed into the internal thread 85 formed in the outer tube mounting area 22 of the telescope so that the spring cap 124 engages the outside 128 of the inner tube 58.

When positioned thusly, the bias spring 126 will bias or provide a directional force to the outer surface 128 of the inner erector guide tube 58 keeping it tightly positioned against the two adjustment screws 18 and 20 as they are turned during the alignment procedure. The user of the telescope will make adjustments to the two adjustment screws 18 and 20 to obtain the proper alignment of the telescope by moving the inner tube 58 around inside the outer tube 21 in the area 94 as shown in FIG. 9 of the drawings until it is positioned in a desired position such as the position shown in FIG. 10 of the drawings.

When the inner tube 58 is in a proper aligned position, such as that shown in FIG. 10, the lock tool or screw driver (not shown) is inserted into the slot 149 on the locking screw 130 to turn the locking screw 130 as required until the upper end 156 of the locking screw 130 grounds or touches on the outside surface 128 of the inner tube 58.

When this occurs, the bias spring cap 124 is totally contained inside the inner bore 131 and the bias spring 126 is inactivated so that the bias force of the spring 126 and the bias spring cap 124 can not move the inner tube 58 in any direction since the inner tube 58 is now positively locked in a rigid three-point lock from the two adjustment screws 18 and 20 and the novel bias locking screw 80.

When in the position shown in FIG. 10 of the drawings, the telescope inner erector guide tube 58 cannot be moved or relocated unless the locking screw 130 is released or moved away from the inner tube 58. As a result, the accidental jarring or dropping of the firearm or a constant heavy recoil of the firearm will have no effect on the inner tube alignment settings. The cap 152 may then be moved in the direction shown by the arrow 170 and is screwed onto the outer threads 138 of the lock bushing 136.

Figure 12:
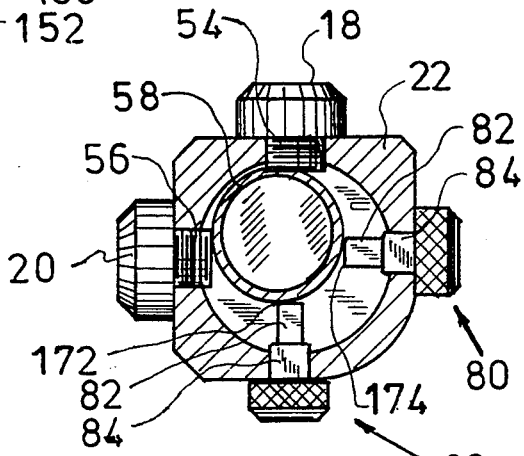
FIG. 12 is a cross sectional view, similar to the view of FIG. 5, showing a modification the applicant's invention using two spring biased locking means positioned opposite to the windage and elevation adjustment screws of the telescope.

Referring now to FIG. 12 of the drawings there is shown a cross sectional view, similar to the view of FIG. 5, showing a modification of the applicant's invention using two spring biased locking means 80 positioned opposite to the two adjustment screws 18 and 20 and used as before described. When this configuration is used, the ends 172 and 174 of the bias would be positioned as shown to provide a double bias force on the inner tube 58 against the two adjustment screws 18 and 20 and would provide a four-point locked position of the inner tube 58.

Figure 13:
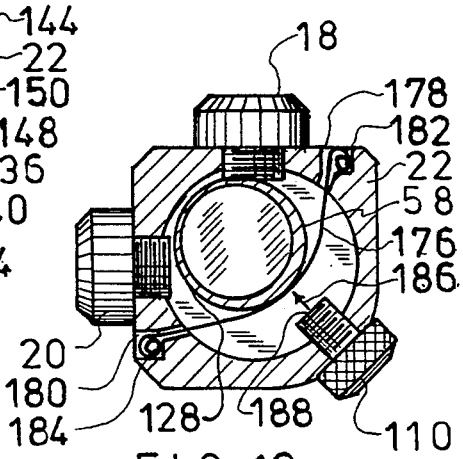
FIG. 13 is a cross sectional view, similar to the view of FIG. 5, showing another modification of the applicant's invention using a constant force spring bias in combination with a separate locking means.

Referring now to FIG. 13 of the drawings there is shown another modification of the applicant's invention. The FIG. 13 view is similar to the view of FIG. 5 and shows the use of a constant force spring bias 176 which has it's ends 182 and 184 positioned in the receiving slots 178 and 180 formed in the outer tube mounting area 22 of the telescope.

When formed thusly, the constant force bias spring 176 will bias the inner tube 58 against the two adjustments screws 18 and 20. When the proper alignment is obtained, the locking screw 110 may be turned to move the screw end 188 in the direction shown by the arrow 186 until it is grounded against the spring 176 which is then grounded on the outer surface 128 of the inner tube 58. This also provides a positive lock of the inner tube and the constant bias spring 176 would be, in effect, inactivated at that time as before described with the previous embodiments.

Figure 14:
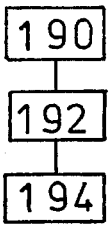
FIG. 14 is a schematic diagram showing the steps in one of the methods of the applicant's invention.

Referring now to FIG. 14 of the drawings, there will be described the novel method using the applicant's invention. The telescope is provided with at least three locking means spaced apart around the inner tube. One of the locking means is the windage adjustment screw and one of the locking means is the elevation adjustment screw. The third locking means may be the applicant's novel biased locking means or may be a separate locking screw with a separate spring bias acting on the inner tube. This step is shown in FIG. 14 as the numeral 190.

The position of the inner tube 58 of the telescope is then adjusted as many times as needed or desired using the windage and elevation locking means to move the inner tube 58 against the spring bias. This step is shown in FIG. 14 as the numeral 192.

The inner tube is then locked in place by moving the third locking means to lock the inner tube 58 against the windage and elevation locking means. This step is shown on FIG. 14 as the numeral 194. Other steps in the method may be used as defined in the following claims of the invention which describe several embodiments of the invention.

From the foregoing, there is shown and described a new and novel device and method which accomplishes all of the objects and advantages of the invention and has many other advantages. It is apparent from a study of the patent application that changes may be made in the various parts and their arrangement as well as in the method disclosed herein to provide other modifications. The applicant is not to be limited to the exact embodiments shown and described herein which were given by way of illustration only.

Having described my invention, I claim:

1. An inner bias locking means for use in at least a three point adjustment for an inner tube of a telescope mounting of the type having an adjustable inner tube member surrounded by an outer elongated member of the type having a surrounding mounting area for mounting the telescope to a firearm on the outer member at two spaced apart positions, comprising:

(a) an outer locking means, movably attached to the outer member and moveable towards and away from the inner tube;

(b) an inner bias force means, movably contained within the outer locking means and positioned to provide a directional bias force from the outer locking means to the inner tube; and (c) means, associated with the outer locking means, to move the outer locking means to a rigid position against the inner tube in a desired position, the movement of the outer locking means to a rigid position serving to inactivate the inner bias force means by moving the outer locking means against the inner tube.

2. The bias locking means as defined in claim 1 wherein the inner bias force means moveably contained within the outer locking means comprises:

(a) a spring cap; and (b) a compression spring, positioned within the spring cap and urging a directional force on the spring cap so that the spring cap can engage the adjustable inner tube member.

3. A method for adjusting and then positively locking a telescope inner lens mounting tube in a desired position while the telescope is attached to a firearm, comprising the steps of:

(a) providing the telescope with at least three locking means spaced apart around the telescope tube and with at least one guide tube bias, one of the locking means being a windage adjustment screw, one of the locking means being an elevation adjustment screw and one of the locking means being an oppositely positioned biased locking means operating to bias the inner tube and to lock the inner tube against the other two locking means as desired;

(b) adjusting the position of the inner tube as many times as desired by using two of the locking means to move the inner tube against the bias until a desired position is obtained; and (c) locking the inner tube in a desired position by operating the oppositely positioned locking means to lock the inner tube against the windage and elevation adjustment screws and to thereby retain the desired and locked position of the inner tube regardless of motion to the firearm and guide tube.

4. The method for adjusting and then positively locking a telescope inner lens mounting tube as defined in claim 3 further comprising:

(d) unlocking the oppositely positioned locking means: and (e) repeating steps (b) and (c) to obtain a new locked position of the inner tube when desired.

5. The method as defined in claim 3 wherein the telescope is provided with at least four locking means spaced apart around the telescope tube with at least two of the locking means being biased locking means operating with a self contained bias to lock the inner tube against the remaining inner tube locking means.

6. A method for adjusting and then positively locking a telescope inner tube in a desired position while the telescope is attached to a firearm, comprising the steps of:

(a) providing the telescope with at least three erector guide tube locking means spaced apart around the telescope tube, one of the locking means being a windage adjustment screw, one of the locking means being an elevation adjustment screw and one of the locking means being an oppositely positioned locking means to lock the inner tube against the other two locking means as desired;

(b) providing the telescope with a separate tube biasing means for urging the inner tube towards the windage and elevation adjustment screws;

(c) adjusting the position of the inner guide tube as many times as desired by using two of the locking means to move the inner tube against the separate tube biasing means until a desired position is obtained; and (d) locking the inner tube in a desired position by using the oppositely positioned locking means to lock the inner tube against the windage and elevation adjustment screws and to thereby retain the desired and locked position of the inner guide tube regardless of motion to the firearm and inner tube.

7. A bias locking means for use in at least a three point adjustment for a telescope mounting of the type having an adjustable inner tube member surrounded by an outer tube member of the type having a surrounding outer tube mounting area for positioning of adjustment screws, comprising:

(a) an outer locking means, movably attached to the outer tube and moveable towards and away from the inner tube, the outer locking means comprising in part;

(1) a lock bushing rotatably mounted to the outer tube mounting area;

(2) an inner locking screw, rotatably mounted to the lock bushing;

(3) a lock ring rotatably mounted on the lock bushing;

(4) a cap, rotatably mounted to the lock bushing; and (b) an inner bias force means, movably contained within the outer locking means and positioned to provide a directional force or bias to the inner tube; and (c) means, associated with the outer locking means, to move the outer locking means to a rigid position against the inner tube in a desired position, the movement of the outer locking means to a rigid position serving to inactivate the inner bias force means.

8. The bias locking means as defined in claim 7 further comprising an O-ring seal positioned between the locking screw and the lock bushing and an O-ring seal positioned between the lock bushing and the outer tube mounting area to seal the inner tube from moisture and contaminates on the outside of the outer tube.

* * * * *